US012241468B2

(12) United States Patent
Hattori et al.

(10) Patent No.: US 12,241,468 B2
(45) Date of Patent: Mar. 4, 2025

(54) SCROLL ELECTRIC COMPRESSOR

(71) Applicant: KABUSHIKI KAISHA TOYOTA JIDOSHOKKI, Kariya (JP)

(72) Inventors: Yuya Hattori, Aichi-ken (JP); Ami Fujiwara, Aichi-ken (JP)

(73) Assignee: KABUSHIKI KAISHA TOYOTA JIDOSHOKKI, Kariya (JP)

( * ) Notice: Subject to any disclaimer, the term of this patent is extended or adjusted under 35 U.S.C. 154(b) by 0 days.

(21) Appl. No.: 18/100,794

(22) Filed: Jan. 24, 2023

(65) Prior Publication Data

US 2023/0258185 A1 Aug. 17, 2023

(30) Foreign Application Priority Data

Jan. 26, 2022 (JP) ..... 2022-009986

(51) Int. Cl.

| | |
|---|---|
| ***F04C 29/02*** | (2006.01) |
| ***F01C 21/10*** | (2006.01) |
| ***F04C 18/02*** | (2006.01) |
| ***F04C 27/00*** | (2006.01) |
| ***F04C 29/12*** | (2006.01) |

(52) U.S. Cl.

CPC ..... *F04C 29/026* (2013.01); *F01C 21/10* (2013.01); *F04C 18/0215* (2013.01); *F04C 18/0253* (2013.01); *F04C 27/00* (2013.01); *F04C 29/028* (2013.01); *F04C 29/12* (2013.01); *F04C 2240/30* (2013.01); *F04C 2240/809* (2013.01)

(58) Field of Classification Search

CPC ..... F04C 29/026; F04C 18/0215; F04C 18/0253; F04C 27/00; F04C 29/028; F04C 29/12; F04C 2240/30; F04C 2240/809; F04C 29/02; F01C 21/10

See application file for complete search history.

(56) References Cited

U.S. PATENT DOCUMENTS 6,152,713 A * 11/2000 Hisanaga ..... F04C 29/12 418/55.6
6,749,404 B2 * 6/2004 Gennami ..... F04C 28/265 417/212

(Continued)

FOREIGN PATENT DOCUMENTS

JP 2002-257062 A 9/2002
JP 2011-85066 A 4/2011

(Continued)

OTHER PUBLICATIONS

Communication dated Oct. 29, 2024, issued in Japanese Application No. 2022-009986.

*Primary Examiner* — David N Brandt
(74) *Attorney, Agent, or Firm* — Sughrue Mion, PLLC

(57) ABSTRACT

A scroll electric compressor includes a housing, a rotary shaft, an electric motor, a fixed scroll, an orbiting scroll, a compression chamber, a discharge chamber, and an oil storage chamber. The housing has a discharge housing including an end wall, a first peripheral wall, a stepped portion, and a second peripheral wall. The fixed scroll has a flange in contact with the second peripheral wall. The stepped portion, the second peripheral wall, the flange, the outer peripheral wall cooperate to define an annular space around the fixed scroll. The annular space is in communication with the discharge chamber or the oil storage chamber.

7 Claims, 7 Drawing Sheets

(56) References Cited

U.S. PATENT DOCUMENTS

| | | | | |
|---|---|---|---|---|
| 2012/0263615 | A1 | 10/2012 | Iizuka et al. | |
| 2019/0101119 | A1* | 4/2019 | Hattori | F04C 29/026 |

FOREIGN PATENT DOCUMENTS

| | | | |
|---|---|---|---|
| JP | 2016-35204 | A | 3/2016 |
| JP | 2019-56322 | A | 4/2019 |
| JP | 2020-165362 | A | 10/2020 |
| KR | 10-2019-0038388 | A | 4/2019 |

* cited by examiner

SCROLL ELECTRIC COMPRESSOR

CROSS-REFERENCE TO RELATED APPLICATION

This application claims priority to Japanese Patent Application No. 2022-009986 filed on Jan. 26, 2022, the entire disclosure of which is incorporated herein by reference.

BACKGROUND ART

The present disclosure relates to a scroll electric compressor.

Japanese Patent Application Publication No. 2020-165362 discloses a scroll electric compressor including a housing, a rotary shaft, and an electric motor. The rotary shaft is rotatably supported by the housing. The electric motor rotates the rotary shaft. The scroll electric compressor includes a fixed scroll, an orbiting scroll, and a compression chamber. The fixed scroll has a fixed scroll base plate, a fixed scroll spiral wall, and an outer peripheral wall. The fixed scroll spiral wall and the outer peripheral wall extend from the fixed scroll base plate. The outer peripheral wall surrounds the fixed scroll spiral wall. The orbiting scroll includes an orbiting scroll spiral wall. The orbiting scroll spiral wall meshes with the fixed scroll spiral wall. The orbiting scroll makes orbital motion with the rotation of the rotary shaft. A compression chamber is defined between the fixed scroll spiral wall and the orbiting scroll spiral wall. Refrigerant from outside is drawn into and compressed in the compression chamber. In addition, the scroll electric compressor has a discharge chamber and an oil storage chamber. Refrigerant compressed in the compression chamber is discharged to the discharge chamber. Oil separated from the refrigerant discharged to the discharge chamber is stored in the oil storage chamber.

In such a scroll electric compressor, reduction of noise and vibration of the scroll-type electric compressor is desired. Pulsation of the refrigerant discharged to the discharge chamber is a cause of noise and vibration. Therefore, there is a demand for increasing the capacity of the discharge chamber without increasing the size of the scroll electric compressor, especially without increasing the dimension of the scroll electric compressor in an axial direction of the rotary shaft.

SUMMARY

According to one aspect of the present disclosure, there is provided a scroll electric compressor including a housing, a rotary shaft rotatably supported by the housing, an electric motor rotating the rotary shaft, a fixed scroll having a fixed scroll base plate, a fixed scroll spiral wall that extends from the fixed scroll base plate, an outer peripheral wall that extends from the fixed scroll base plate and surrounds the fixed scroll spiral wall, an orbiting scroll having an orbiting scroll spiral wall that meshes with the fixed scroll spiral wall and configured to make orbital motion, a compression chamber that is defined between the fixed scroll spiral wall and the orbiting scroll spiral wall, into which refrigerant from an outside is drawn, and in which the refrigerant is compressed, a discharge chamber to which the refrigerant compressed in the compression chamber is discharged, and an oil storage chamber in which oil separated from the refrigerant discharged to the discharge chamber is stored. The housing has a discharge housing including an end wall, a first peripheral wall that extends from the end wall in a tubular shape and is in contact with the fixed scroll base plate, a stepped portion that has an annular shape and extends outwardly from the first peripheral wall in a radial direction of the rotary shaft, and a second peripheral wall extending from the stepped portion on an opposite side from the first peripheral wall in a tubular shape. The discharge chamber and the oil storage chamber are formed in a space defined by the end wall, the first peripheral wall, and the fixed scroll base plate. The fixed scroll has a flange that has a ring shape, projects from the outer peripheral wall in the radial direction, and is in contact with the second peripheral wall. The stepped portion, the second peripheral wall, the flange, the outer peripheral wall cooperate to define an annular space around the fixed scroll. The annular space is in communication with the discharge chamber or the oil storage chamber.

Other aspects and advantages of the disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the embodiments together with the accompanying drawings in which.

DETAILED DESCRIPTION OF THE EMBODIMENTS

The following will describe an embodiment of a scroll electric compressor with reference to FIGS. 1 to 4. The scroll electric compressor of the present embodiment is used for a vehicle air conditioner, for example.

(Overall Configuration of a Scroll Electric Compressor 10)

Figure 1:
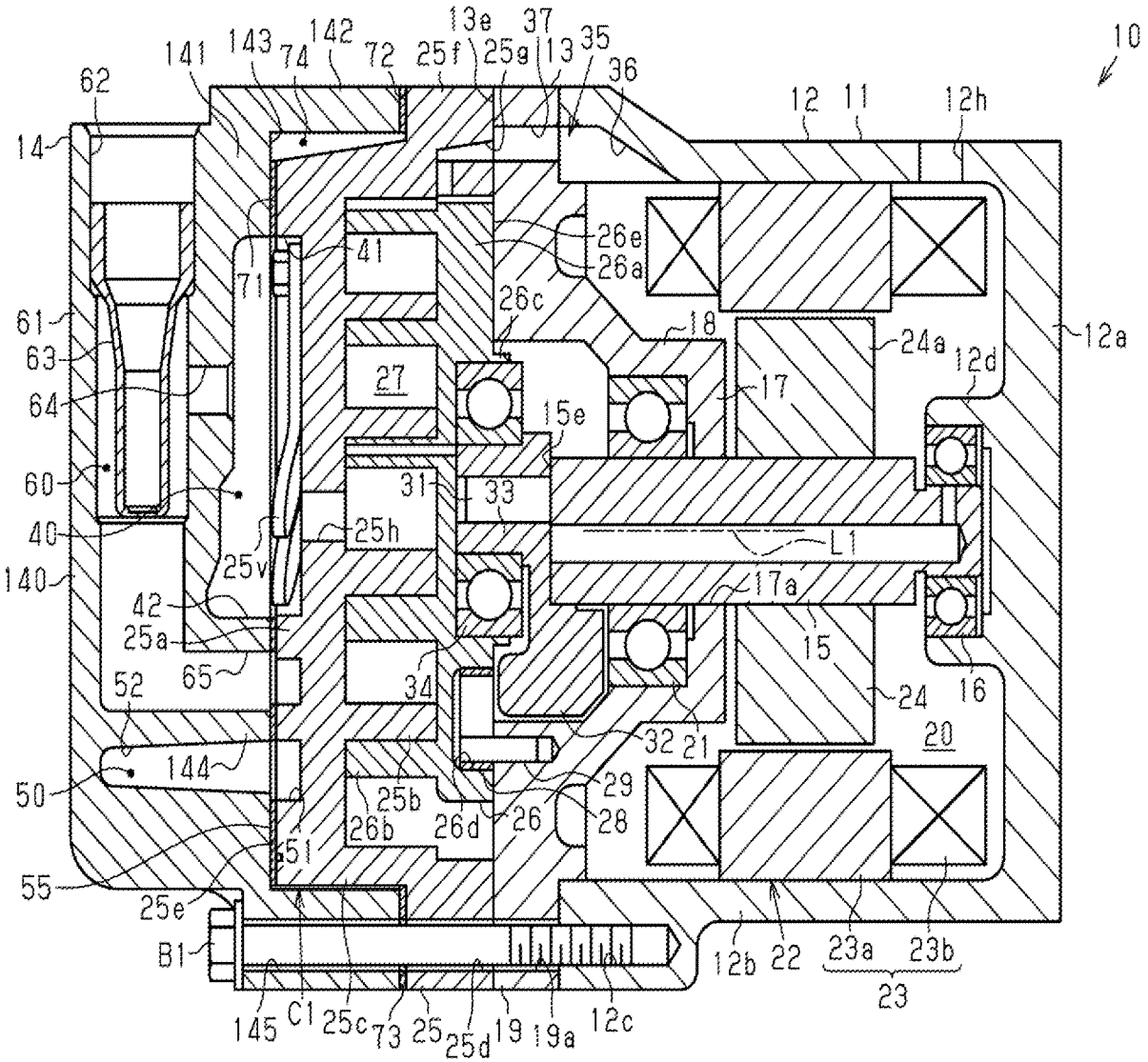
FIG. 1 is a cross-sectional view, illustrating a scroll electric compressor according to an embodiment.

As illustrated in FIG. 1, a scroll electric compressor 10 includes a housing 11 having a tubular shape. The housing 11 includes a motor housing 12, a shaft support housing 13, and a discharge housing 14. The motor housing 12, the shaft support housing 13, and the discharge housing 14 are made of a metallic material, such as aluminum. In addition, the scroll electric compressor 10 includes a rotary shaft 15. The rotary shaft 15 is accommodated in the housing 11.

(Motor Housing 12)

The motor housing 12 includes an end wall 12*a* having a plate shape, and a peripheral wall 12*b* having a tubular shape. The peripheral wall 12*b* extends from an outer peripheral portion of the end wall 12*a* in a tubular shape. An axial direction of the peripheral wall 12*b* coincides with an axial direction of the rotary shaft 15. A plurality of internally threaded holes 12*c* are formed in an opened end of the peripheral wall 12*b*. For the sake of description, only one of the internally threaded holes 12*c* is illustrated in FIG. 1. The motor housing 12 has a suction port 12*h* through which refrigerant is drawn. The suction port 12*h* is formed in a portion of the peripheral wall 12*b* located on the end wall 12*a* side. The suction port 12*h* provides communication between an inside and an outside of the motor housing 12.

A boss 12*d* having a cylindrical shape protrudes from an inner surface of the end wall 12*a*. A first end of the rotary shaft 15 corresponding to one end of the rotary shaft 15 in the axial direction is inserted into the boss 12*d*. A roller bearing 16 is disposed between an inner peripheral surface of the boss 12*d* and an outer peripheral surface of the first end of the rotary shaft 15. The first end of the rotary shaft 15 is rotatably supported by the motor housing 12 via the roller bearing 16.

(Shaft Support Housing 13)

The shaft support housing 13 has an end wall 17 having a plate shape and a peripheral wall 18 having a tubular shape. The peripheral wall 18 extends from an outer peripheral portion of the end wall 17 in a tubular shape. An axial direction of the peripheral wall 18 coincides with the axial direction of the rotary shaft 15. The shaft support housing 13 has a flange wall 19 having a ring shape. The flange wall 19 extends in a radially outward direction of the rotary shaft 15 from an end of an outer peripheral surface of the peripheral wall 18 on a side opposite to the end wall 17. An outer peripheral portion of the flange wall 19 is in contact with the opened end of the peripheral wall 12*b* of the motor housing 12 in the axial direction of the rotary shaft 15. Specifically, the outer peripheral portion of the flange wall 19 is in contact with the peripheral wall 12*b* of the motor housing 12 through a sealing member (not illustrated).

A plurality of bolt insertion holes 19*a* are formed in the outer peripheral portion of the flange wall 19. Each of the bolt insertion holes 19*a* extends through the flange wall 19 in a thickness direction thereof. Each of the bolt insertion holes 19*a* of the flange wall 19 is in communication with its associated internally threaded hole 12*c* of the motor housing 12. For the sake of description, only one of the bolt insertion holes 19*a* is illustrated in FIG. 1.

A motor chamber 20 is defined by the motor housing 12 and the shaft support housing 13 in the housing 11. Thus, the motor housing 12 and the shaft support housing 13 cooperate to define the motor chamber 20. Refrigerant is drawn into the motor chamber 20 through the suction port 12*h*. Thus, the motor chamber 20 is in a suction pressure region.

An insertion hole 17*a* having a circular hole shape is formed at the center of the end wall 17. The insertion hole 17*a* extends through the end wall 17 in a thickness direction. The rotary shaft 15 is inserted through the insertion hole 17*a*. An end surface 15*e* of the rotary shaft 15 positioned on a second end side of the rotary shaft 15 corresponding to the other end thereof in the axial direction is positioned inside the peripheral wall 18. A roller bearing 21 is disposed between an inner peripheral surface of the peripheral wall 18 and the outer peripheral surface of the rotary shaft 15. The rotary shaft 15 is rotatably supported by the shaft support housing 13 via the roller bearing 21. Thus, the shaft support housing 13 rotatably supports the rotary shaft 15. The rotary shaft 15 is rotatably supported by the housing 11.

(Electric Motor 22)

The scroll electric compressor 10 includes an electric motor 22. The electric motor 22 is accommodated in the motor chamber 20. The electric motor 22 includes a stator 23 having a tubular shape, and a rotor 24 having a tubular shape. The rotor 24 is disposed inside the stator 23. The rotor 24 rotates together with the rotary shaft 15. The stator 23 surrounds the rotor 24. The rotor 24 includes a rotor core 24*a* fixed to the rotary shaft 15, and a plurality of permanent magnets (not illustrated) disposed in the rotor core 24*a*.

The stator 23 includes a stator core 23*a* having a tubular shape, and a motor coil 23*b*. The stator core 23*a* is fixed to the inner peripheral surface of the peripheral wall 12*b* of the motor housing 12. The motor coil 23*b* is wound on the stator core 23*a*. The rotor 24 rotates with electric power controlled by a drive circuit (not illustrated) supplied to the motor coil 23*b*, so that the rotary shaft 15 rotates together with the rotor 24. Thus, the electric motor 22 rotates the rotary shaft 15.

(Fixed Scroll 25 and Orbiting Scroll 26)

The scroll electric compressor 10 includes a compression mechanism C1. The compression mechanism C1 includes a fixed scroll 25 and an orbiting scroll 26. That is, the scroll electric compressor 10 includes the fixed scroll 25 and the orbiting scroll 26. The orbiting scroll 26 makes orbital motion relative to the fixed scroll 25 with the rotation of the rotary shaft 15.

Figure 2:
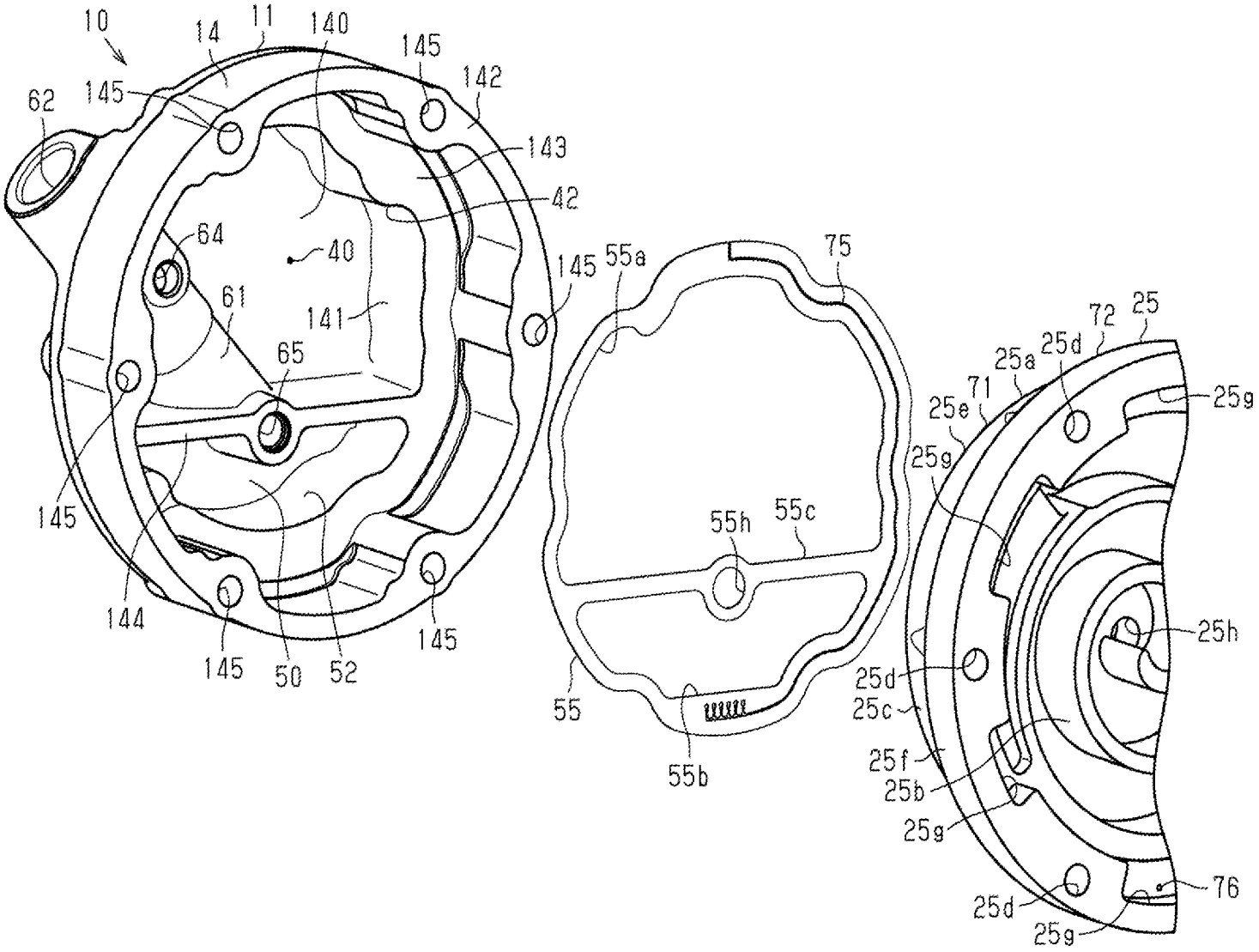
FIG. 2 is an exploded perspective view, illustrating a part of the scroll electric compressor.

As illustrated in FIGS. 1 and 2, the fixed scroll 25 has a fixed scroll base plate 25*a*, a fixed scroll spiral wall 25*b*, and an outer peripheral wall 25*c*. The fixed scroll base plate 25*a* has a disk shape. A discharge port 25*h* is formed at the center of the fixed scroll base plate 25*a*. The discharge port 25*h* has a circular hole shape. The discharge port 25*h* extends through the fixed scroll base plate 25*a* in a thickness direction thereof. The fixed scroll spiral wall 25*b* extends from the fixed scroll base plate 25*a*. The outer peripheral wall 25*c* extends from an outer peripheral portion of the fixed scroll base plate 25*a*. The outer peripheral wall 25*c* surrounds the fixed scroll spiral wall 25*b*. An outer peripheral surface of the outer peripheral wall 25*c* has a conical surface shape whose outer diameter increases as being away from the fixed scroll base plate 25*a*.

Figure 3:
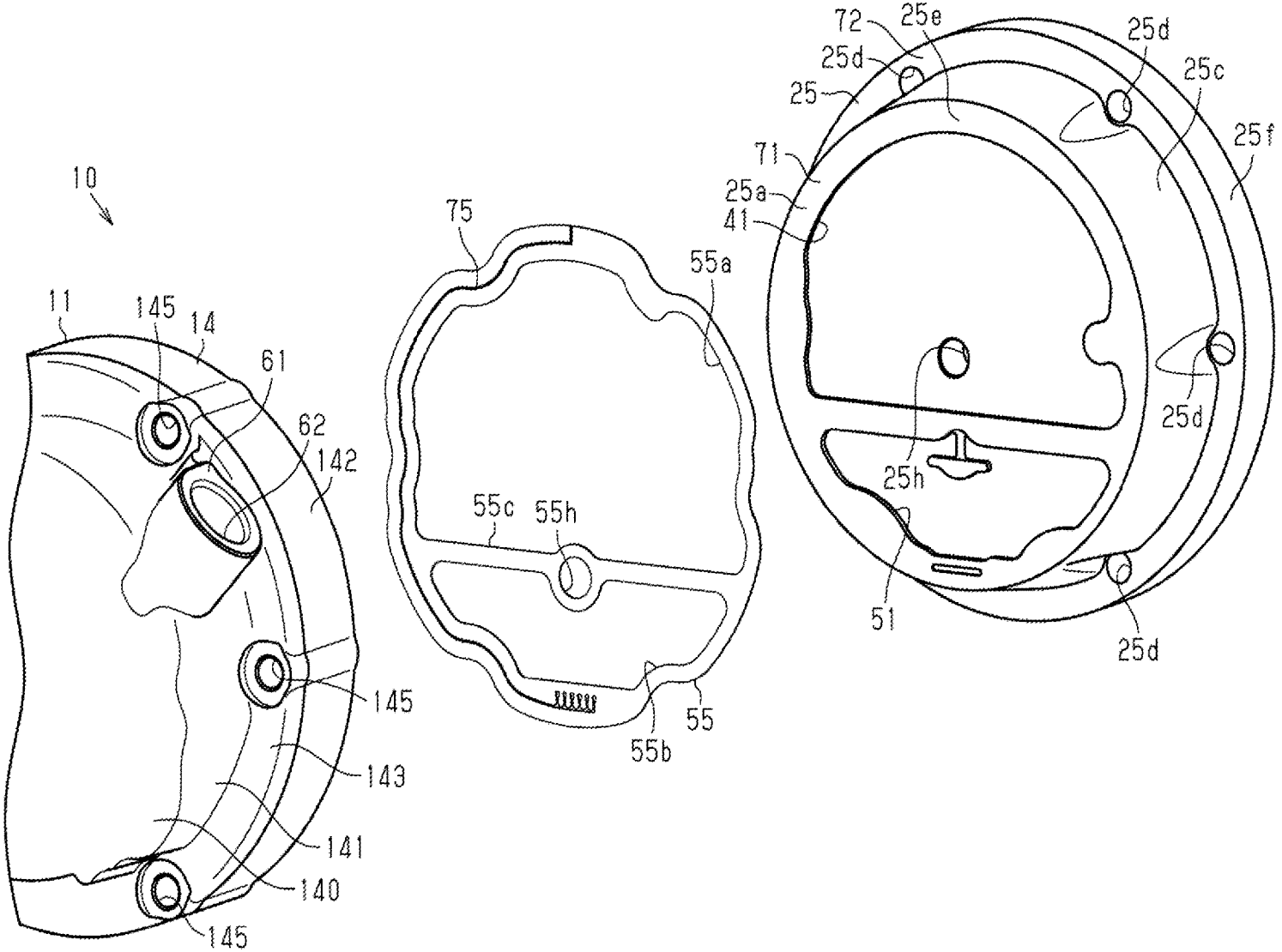
FIG. 3 is an exploded perspective view, illustrating a part of the scroll electric compressor.

As illustrated in FIGS. 2 and 3, the fixed scroll 25 has a flange 25*f* having a ring shape. The flange 25*f* projects from an end of the outer peripheral surface of the outer peripheral wall 25*c* on a side opposite to the fixed scroll base plate 25*a* in a radial direction thereof. A plurality of bolt insertion holes 25*d* are formed in the flange 25*f*. The bolt insertion holes 25*d* extend through the flange 25*f* in a thickness direction thereof. As illustrated in FIG. 1, the bolt insertion holes 25*d* are in communication with their associated bolt insertion holes 19*a* of the flange wall 19. The bolt insertion holes 25*d* are arranged at predetermined intervals from each other in a circumferential direction of the flange 25*f*. For the sake of description, only one of the bolt insertion holes 25*d* is illustrated in FIG. 1.

As illustrated in FIG. 2, a plurality of passage recesses 25*g* are formed in an opened end surface of the outer peripheral wall 25*c*. The passage recesses 25*g* are arranged at predetermined intervals in a circumferential direction of the outer peripheral wall 25*c*. The passage recesses 25*g* are opened at the opened end surface of the outer peripheral wall 25*c*. The passage recesses 25*g* are opened at the inner peripheral surface of the outer peripheral wall 25*c*.

As illustrated in FIGS. 1 and 3, a first discharge chamber forming recess 41 and a first oil storage chamber forming recess 51 are formed in the end surface 25*e* of the fixed scroll base plate 25*a*. The discharge port 25*h* is opened in a bottom surface of the first discharge chamber forming recess 41. As illustrated in FIG. 1, the scroll electric compressor 10 includes a valve mechanism 25*v*. The valve mechanism 25*v* is mounted to the bottom surface of the first discharge chamber forming recess 41. The valve mechanism 25*v* is configured to open or close the discharge port 25*h*.

The orbiting scroll 26 includes an orbiting scroll base plate 26*a* and an orbiting scroll spiral wall 26*b*. The orbiting scroll base plate 26*a* has a disk shape. The orbiting scroll base plate 26*a* faces the fixed scroll base plate 25*a*. The orbiting scroll spiral wall 26*b* extends from the orbiting scroll base plate 26*a* towards the fixed scroll base plate 25*a*. The orbiting scroll spiral wall 26*b* meshes with the fixed scroll spiral wall 25*b*. The orbiting scroll 26 is disposed inside the outer peripheral wall 25*c*. The orbiting scroll 26 makes orbital motion inside the outer peripheral wall 25*c*. A distal end surface of the fixed scroll spiral wall 25*b* is in contact with the orbiting scroll base plate 26*a*, and a distal end surface of the orbiting scroll spiral wall 26*b* is in contact with the fixed scroll base plate 25*a*. The fixed scroll base plate 25*a*, the fixed scroll spiral wall 25*b*, the orbiting scroll base plate 26*a*, and the orbiting scroll spiral wall 26*b* cooperate to define a compression chamber 27 in which refrigerant is compressed. Thus, the compression chamber 27 is defined between the fixed scroll spiral wall 25*b* and the orbiting scroll spiral wall 26*b*, and compresses refrigerant introduced from an outside.

The orbiting scroll base plate 26*a* has a boss 26*c* having a cylindrical shape. The boss 26*c* projects from an end surface 26*e* of the orbiting scroll base plate 26*a* on a side opposite to the fixed scroll base plate 25*a*. An axial direction of the boss 26*c* coincides with the axial direction of the rotary shaft 15. The orbiting scroll base plate 26*a* has a plurality of grooves 26*d*. The grooves 26*d* are formed in the end surface 26*e* of the orbiting scroll base plate 26*a* around the boss 26*c*. The grooves 26*d* are disposed at predetermined intervals in a circumferential direction of the rotary shaft 15. A ring member 28 having a ring shape is fitted into each of the grooves 26*d*. A pin 29 is inserted into each of the ring member 28. Each pin 29 is formed protruding from the end surface 13*e* of the shaft support housing 13 on the orbiting scroll 26 side.

(Eccentric Shaft 31)

The scroll electric compressor 10 includes an eccentric shaft 31. The eccentric shaft 31 extends from the end surface 15*e* of the rotary shaft 15 at a position eccentric to an axial line L1 of the rotary shaft 15 toward the orbiting scroll 26. The eccentric shaft 31 is formed integrally with the rotary shaft 15. An axial direction of the eccentric shaft 31 coincides with the axial direction of the rotary shaft 15. The eccentric shaft 31 is inserted into the boss 26*c*.

(Balance Weight 32 and Bushing 33)

The scroll electric compressor 10 includes a balance weight 32 and a bushing 33. The bushing 33 is fitted to an outer peripheral surface of the eccentric shaft 31. The balance weight 32 is integrated into the bushing 33. The balance weight 32 is formed integrally with the bushing 33. The balance weight 32 is accommodated in the peripheral wall 18 of the shaft support housing 13. The orbiting scroll 26 is supported by the eccentric shaft 31 via the bushing 33 and the roller bearing 34, and is rotatable relative to the eccentric shaft 31.

The rotation of the rotary shaft 15 is transmitted to the orbiting scroll 26 through the eccentric shaft 31, the bushing 33, and the roller bearing .34, which rotates the orbiting scroll 26. Each pin 29 in contact with the inner peripheral surface of its associated ring member 28 prevents the orbiting scroll 26 from rotating, but only allows the orbiting scroll 26 to make orbital motion. Thus, the orbiting scroll 26 makes orbital motion while the orbiting scroll spiral wall 26*b* is in contact with the fixed scroll spiral wall 25*b*, which reduces the volume of the compression chamber 27 to compress refrigerant. The orbiting scroll 26 makes orbital motion inside the outer peripheral wall 25*c* with the rotation of the rotary shaft 15. The balance weight 32 reduces an amount of unbalance of the orbiting scroll 26 by offsetting the centrifugal force acting on the orbiting scroll 26 during the orbital motion of the orbiting scroll 26.

(Suction Passage 35)

The scroll electric compressor 10 includes a suction passage 35. The suction passage 35 is formed by a plurality of suction grooves 36, a plurality of suction ports 37, and a plurality of passage recesses 25*g*. The plurality of suction grooves 36 are formed in a part of the inner peripheral surface of the peripheral wall 12*b* of the motor housing 12. Each of the suction grooves 36 is opened at an opened end of the peripheral wall 12*b*. The plurality of suction ports 37 are formed in the outer peripheral portion of the flange wall 19 of the shaft support housing 13. The suction ports 37 provide communication between their associated suction grooves 36 and the passage recesses 25*g*. The suction ports 37 extend through the flange wall 19 in a thickness direction thereof.

Refrigerant in the motor chamber 20 passes through the suction grooves 36, the suction ports 37, and the passage recesses 25*g*, and is drawn into the compression chamber 27. Thus, the suction grooves 36, the suction ports 37, and the passage recesses 25*g* are in a suction pressure region through which refrigerant is drawn into the compression chamber 27. The refrigerant drawn into the compression chamber 27 is compressed in the compression chamber 27 with the orbital motion of the orbiting scroll 26.

(Discharge Housing 14)

As illustrated in FIG. 2, the discharge housing 14 has an end wall 140 having a plate shape, a first peripheral wall 141, a stepped portion 143, and a second peripheral wall 142. The first peripheral wall 141 extends from the outer peripheral portion of the end wall 140 in a tubular shape. An inside of the first peripheral wall 141 is divided into a second discharge chamber forming recess 42 and a second oil storage chamber forming recess 52 by a partition wall 144. Thus, the first peripheral wall 141 forms the second discharge chamber forming recess 42 and the second oil storage chamber forming recess 52. The second discharge chamber forming recess 42 and the first discharge chamber forming recess 41 have substantially the same shape. The second oil storage chamber forming recess 52 and the first oil storage chamber forming recess 51 has substantially the same shape.

The stepped portion 143 has an annular shape extending outwardly from the first peripheral wall 141 in the radial direction of the rotary shaft 15. The stepped portion 143 connects the first peripheral wall 141 with the second peripheral wall 142. The stepped portion 143 is a flat surface extending in the radial direction of the rotary shaft 15. The second peripheral wall 142 extends from the stepped portion 143 in a direction opposite from the first peripheral wall 141 in a tubular shape. An opened end of the second peripheral wall 142 faces the flange 25*f* in the axial direction of the rotary shaft 15. A plurality of bolt insertion holes 145 are formed in the second peripheral wall 142. The bolt insertion holes 145 are arranged at predetermined intervals in the circumferential direction of the rotary shaft 15. The bolt insertion holes 145 are in communication with their associated bolt insertion holes 25*d* of the flange 25*f*.

As illustrated in FIG. 1, the scroll electric compressor 10 includes through bolts B1. The through bolts B1 are inserted through the bolt insertion holes 145 of the discharge housing 14, the bolt insertion holes 25*d* of the fixed scroll 25, the bolt insertion holes 19*a* of the shaft support housing 13 in this order, and screwed into the internally threaded holes 12*c*. Thus, the through bolts B1 extend through the second peripheral wall 142 of the discharge housing 14, the flange 25*f* of the fixed scroll 25, and the flange wall 19 of the shaft support housing 13, and are screwed into the peripheral wall 12*b* of the motor housing 12. The discharge housing 14, the fixed scroll 25, the shaft support housing 13, and the motor housing 12 are arranged in this order and integrally fixed by the through bolts B1 in the axial direction of the rotary shaft 15. Thus, the motor housing 12, the shaft support housing 13, the fixed scroll 25, and the discharge housing 14 are arranged in this order in the axial direction of the rotary shaft 15.

(Gasket 55)

As illustrated in FIGS. 2 and 3, the scroll electric compressor 10 includes a gasket 55 having an annular shape. The gasket 55 has a thin plate shape and is made of a metal. The gasket 55 provides sealing between the discharge housing 14 and the fixed scroll base plate 25*a*. The gasket 55 is interposed between the outer peripheral portion of the end surface 25*e* of the fixed scroll base plate 25*a* and the opened end surface of the first peripheral wall 141 of the discharge housing 14.

The gasket 55 has a discharge chamber communication hole 55*a*, and an oil storage chamber communication hole 55*b*. The discharge chamber communication hole 55*a* and the oil storage chamber communication hole 55*b* are divided by a gasket partition wall 55*c*. The discharge chamber communication hole 55*a*, the first discharge chamber forming recess 41, and the second discharge chamber forming recess 42 have substantially the same shape. The oil storage chamber communication hole 55*b*, the first oil storage chamber forming recess 51, and the second oil storage chamber forming recess 52 have substantially the same shape. The gasket partition wall 55*c* and the partition wall 144 of the discharge housing 14 have substantially the same shape. The gasket partition wall 55*c* has a through hole 55*h*. The through hole 55*h* extends through the gasket partition wall 55*c* in a thickness direction thereof.

(Discharge Chamber 40)

The first discharge chamber forming recess 41, and the second discharge chamber forming recess 42 are in communication through the discharge chamber communication hole 55*a*. The first discharge chamber forming recess 41 and the second discharge chamber forming recess 42 cooperate to form a discharge chamber 40. Thus, the scroll electric compressor 10 has the discharge chamber 40. Refrigerant compressed in the compression chamber 27 is discharged to the discharge chamber 40.

(Oil Storage Chamber 50)

The first oil storage chamber forming recess 51, and the second oil storage chamber forming recess 52 are in communication through the oil storage chamber communication hole 55*b*. An oil storage chamber 50 is defined by the first oil storage chamber forming recess 51 and the second oil storage chamber forming recess 52. Thus, the discharge housing 14 and the fixed scroll base plate 25*a* cooperate to define the discharge chamber 40 and the oil storage chamber 50. The discharge chamber 40 and the oil storage chamber 50 are formed in a space defined by the end wall 140, the first peripheral wall 141, and the fixed scroll base plate 25*a*. The gasket 55 provides sealing between the discharge chamber 40 and the oil storage chamber 50. The scroll electric compressor 10 of the present embodiment is mounted on a vehicle so that the oil storage chamber 50 is positioned lower than the discharge chamber 40.

(Oil Separation Chamber 60)

As illustrated in FIG. 1, the scroll electric compressor 10 has an oil separation chamber 60. The oil separation chamber 60 is formed inside the discharge housing 14. The oil separation chamber 60 is formed in an outer tube 61 which is a part of the end wall 140 of the discharge housing 14 and has an elongated tubular shape. A first end of the outer tube 61 serves as a discharge port 62 through which refrigerant is discharged to an outside. The discharge port 62 is in communication with the oil separation chamber 60. Thus, the oil separation chamber 60 is in a discharge pressure region.

An inner tube 63 is fitted into the oil separation chamber 60. An axial direction of the inner tube 63 coincides with the radial direction of the rotary shaft 15. A first end of the inner tube 63 is in communication with the discharge port 62. A second end of the inner tube 63 is in communication with an inside of the oil separation chamber 60 on a opposite side from the discharge port 62. As illustrated in FIGS. 1 and 2, an introduction hole 64 is formed in the outer tube 61. The introduction hole 64 provides communication between the discharge chamber 40 and the oil separation chamber 60. Refrigerant discharged to the discharge chamber 40 is introduced into the oil separation chamber 60 through the introduction hole 64.

An oil discharge hole 65 is formed in the discharge housing 14. A first end of the oil discharge hole 65 is in communication with the inside of the oil separation chamber 60 on a opposite side from the discharge port 62. A second end of the oil discharge hole 65 is opened at the opened end surface of the partition wall 144 of the discharge housing 14. The oil discharge hole 65 is in communication with the through hole 55*h* of the gasket 55. The oil separation chamber 60 is in communication with the first oil storage chamber forming recess 51 through the oil discharge hole 65 and the through hole 55*h*. Thus, the oil separation chamber 60 is in communication with the oil storage chamber 50 through the oil discharge hole 65 and the through hole 55*h*. Accordingly, the oil storage chamber 50 is in the discharge pressure region.

Refrigerant compressed in the compression chamber 27 and discharged to the discharge chamber 40 through the discharge port 25*h* is introduced into the oil separation chamber 60 through the introduction hole 64. The refrigerant introduced into the oil separation chamber 60 swirls around the inner tube 63. Thus, the centrifugal force applies to oil contained in the refrigerant, which causes the oil to be separated from the refrigerant in the oil separation chamber 60. Accordingly, the oil contained in the refrigerant discharged to the discharge chamber 40 is separated in the oil separation chamber 60.

After oil is separated from the refrigerant, the refrigerant flows into and travels through the inner tube 63, and flows out to an external refrigerant circuit (not illustrated) through the discharge port 62. The oil separated from the refrigerant in the oil separation chamber 60 flows towards the oil discharge hole 65 by its own weight, which is then discharged to the oil storage chamber 50 through the oil discharge hole 65 and the through hole 55*h*, and stored in the oil storage chamber 50. Thus, the oil storage chamber 50 stores the oil separated from refrigerant in the oil separation chamber 60.

(First Contact Portion 71)

Figure 4:
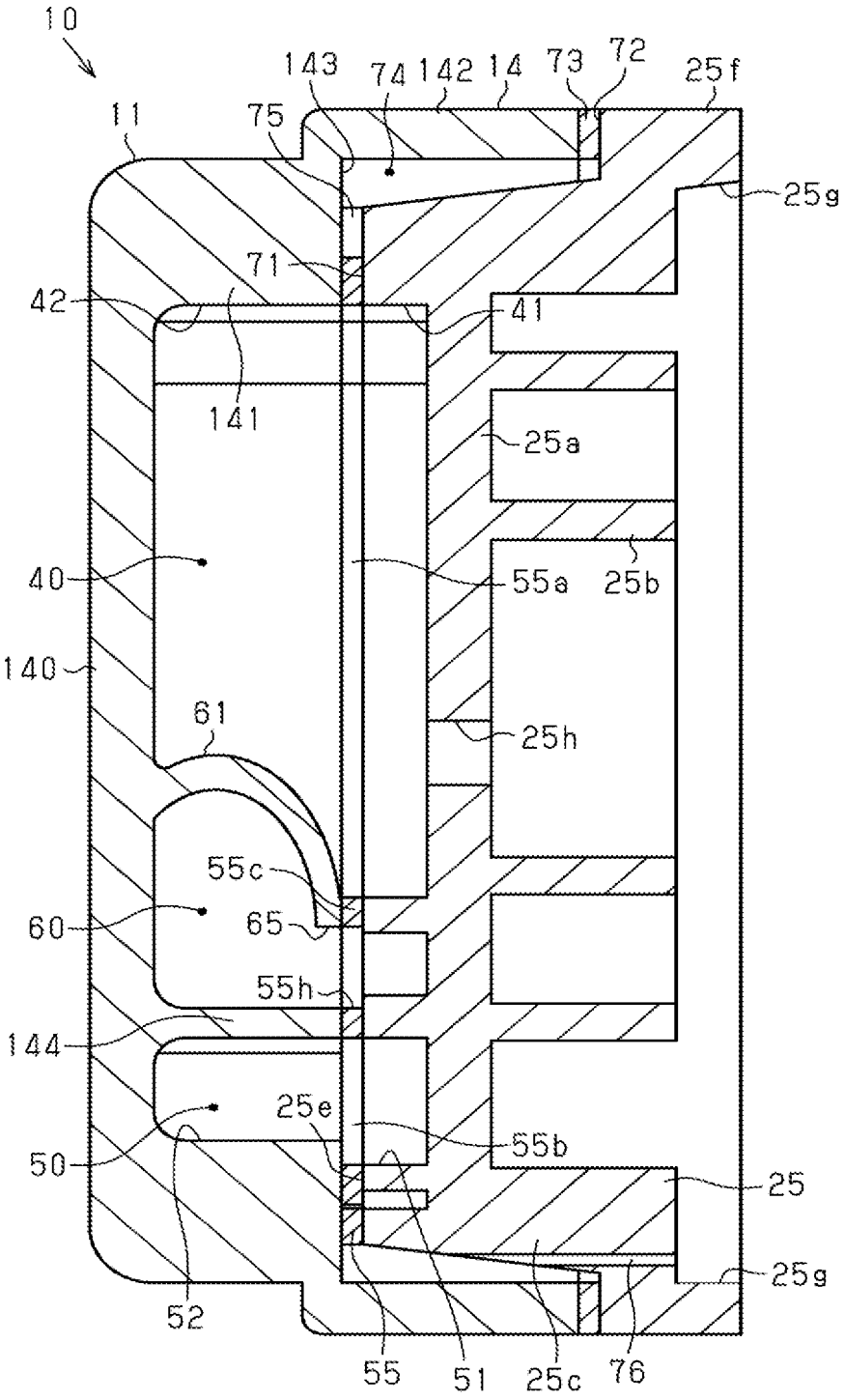
FIG. 4 is a cross-sectional view in which a part of the scroll electric compressor is enlarged.

As illustrated in FIG. 4, an outer peripheral portion of the end surface 25*e* of the fixed scroll base plate 25*a* faces the opened end surface of the first peripheral wall 141 in the axial direction of the rotary shaft 15. The outer peripheral portion of the end surface 25*e* of the fixed scroll base plate 25*a* serves as a first contact portion 71 to be in contact with the first peripheral wall 141. Thus, the fixed scroll base plate 25*a* has the first contact portion 71 in contact with the first peripheral wall 141. Specifically, the first contact portion 71 is in contact with the first peripheral wall 141 via the gasket 55. Accordingly, the first peripheral wall 141 is in contact with the fixed scroll base plate 25*a*.

(Second Contact Portion 72)

The flange 25*f* faces the opened end surface of the second peripheral wall 142 in the axial direction of the rotary shaft 15. A portion of the flange 25*f* facing the opened end surface of the second peripheral wall 142 serves as a second contact portion 72 having an annular shape, which is to be in contact with the second peripheral wall 142. Thus, the fixed scroll 25 has the flange 25*f* having an annular shape, projecting from the outer peripheral wall 25*c* in the radial direction, and being in contact with the second peripheral wall 142. Specifically, the second contact portion 72 of the flange 25*f* is in contact with the second peripheral wall 142 via a sealing member 73. The sealing member 73 is made of, for example, a thin metal plate.

(Annular Space 74)

The scroll electric compressor 10 has an annular space 74. The annular space 74 is defined around the fixed scroll 25 by the stepped portion 143, the second peripheral wall 142, the flange 25*f*, and the outer peripheral wall 25*c*. The gasket 55 provides sealing between the discharge chamber 40 and the annular space 74. In addition, the sealing member 73 provides sealing between the annular space 74 and an outside.

(Throttle Groove 75)

As illustrated in FIGS. 2 and 3, a throttle groove 75 is formed in the gasket 55. The throttle groove 75 extends along an outer peripheral portion of the gasket 55. The throttle groove 75 extends through the gasket 55 in a thickness direction thereof. A first end of the throttle groove 75 is in communication with a lower part of the oil storage chamber 50. A second end of the throttle groove 75 is opened at an outer peripheral edge of the gasket 55 at a position 180 degree away from the first end of the throttle groove 75 in a circumferential direction of the gasket 55. As illustrated in FIG. 4, the second end of the throttle groove 75 is in communication with an upper part of the annular space 74. Thus, the throttle groove 75 provides communication between the annular space 74 and the oil storage chamber 50. Accordingly, the annular space 74 is in communication with the oil storage chamber 50.

(Communication Passage 76)

A communication passage 76 is formed in the outer peripheral wall 25*c* of the fixed scroll 25. The communication passage 76 extends in an axial direction of the outer peripheral wall 25*c*. A first end of the communication passage 76 is opened at the outer peripheral surface of the outer peripheral wall 25*c*. The first end of the communication passage 76 is in communication with the lower part of the annular space 74. A second end of the communication passage 76 is opened at a bottom surface of one of the plurality of passage recesses 25*g*. The communication passage 76 is in communication with the inner side of the one of the plurality of passage recesses 25*g*. Thus, the annular space 74 is in communication with the oil storage chamber 50, and is in communication with the suction pressure region in which refrigerant to be drawn into the compression chamber 27 flows through the communication passage 76. Thus, the annular space 74 is in the suction pressure region.

(Operation)

The following will describe the operation of the present embodiment.

The annular space 74 formed around the fixed scroll 25 by the stepped portion 143, the second peripheral wall 142, the flange 25*f*, and the outer peripheral wall 25*c* is in communication with the oil storage chamber 50. Thus, the annular space 74 functions as the oil storage chamber. As a result, the oil storage chamber 50 can be made smaller by the capacity of the annular space 74, which allows the space of the discharge chamber 40 to be larger. Thus, pulsation of the refrigerant discharged to the discharge chamber 40 may be suppressed.

For example, in a compressor having an oil storage space only in a space in the discharge pressure atmosphere, during the high load operation during which discharge pressure is high, a suction chamber and a discharge chamber may be brought into communication through an oil return passage when an excessive amount of oil is returned due to the application of high discharge pressure to the stored oil, which may cause deterioration of the efficiency. In a compressor having an oil storage chamber only in a space in a suction pressure atmosphere, on the other hand, during the high-speed operation during which the flow rate of refrigerant is high, a large amount of separated oil may not be returned to the oil storage chamber and may be discharged to an outside through a discharge port, which may cause poor lubrication. The scroll electric compressor 10 of the present embodiment has oil storage spaces both in the suction pressure region and the discharge pressure region, namely, the annular space 74 corresponding to the oil storage space exposed to the suction pressure atmosphere, and the discharge chamber 40 corresponding to the oil storage space exposed to the discharge pressure atmosphere. As a result, the above-described problems are less likely to occur.

Advantageous Effect

The above-described embodiment offers the following effects.

(1) The annular space 74, which is defined around the fixed scroll 25 by the stepped portion 143, the second peripheral wall 142, the flange 25*f*, and the outer peripheral wall 25*c*, is in communication with the oil storage chamber 50. Thus, the annular space 74 serves as the oil storage chamber. As a result, the oil storage chamber 50 may be made smaller by the capacity of the annular space 74, which permits increasing the space of the discharge chamber 40. This configuration suppresses pulsation of the refrigerant discharged to the discharge chamber 40, thereby reducing noise and vibration of the scroll electric compressor 10.

(2) The annular space 74 functions as the oil storage chamber. The annular space 74 and the oil storage chamber 50 are in communication through the throttle groove 75 of the gasket 55. Therefore, oil may be stably stored in at least one of the oil storage chamber 50 and the annular space 74 in any operational range of the scroll electric compressor 10. The gasket 55 providing sealing between the discharge housing 14 and the fixed scroll base plate 25*a* is a suitable member for forming the throttle groove 75 through which the annular space 74 and the oil storage chamber 50 are in communication.

(3) For example, in a compressor having an oil storage space only in a space in the discharge pressure atmosphere, during the high load operation during which discharge pressure is high, a suction chamber and a discharge chamber may be brought into communication through an oil return passage when an excessive amount of oil is returned due to the application of high discharge pressure to the stored oil, which may cause deterioration of the efficiency. In a compressor having an oil storage chamber only in a space in a suction pressure atmosphere, on the other hand, during the high-speed operation during which the flow rate of refrigerant is high, a large amount of separated oil may not be returned to the oil storage chamber and may be discharged to an outside through a discharge port, which may cause poor lubrication. The scroll electric compressor 10 of the present embodiment has oil storage spaces both in the suction pressure region and the discharge pressure region, namely, the annular space 74 corresponding to the oil storage space exposed to the suction pressure atmosphere and the discharge chamber 40 corresponding to the oil storage space exposed to the discharge pressure atmosphere. As a result, the above-described problems are less likely to occur.

(4) The annular space 74 is in the suction pressure region. Thus, a pressure difference between the annular space 74 and the outside may be made small, as compared with a case where the annular space 74 is in the discharge pressure region. As a result, leakage of oil from the annular space 74 to the outside may be easily suppressed.

(5) Since the annular space 74 is defined around the fixed scroll 25, the volume of the discharge chamber 40 may be increased without increasing the size of the scroll electric compressor 10, especially the dimension thereof in the axial direction of the rotary shaft 15.

Modified Embodiments

The above-described embodiment may be modified in various manners, as exemplified below. The above-described embodiment and its modified embodiments may be combined within the scope consistent with the present disclosure.

Figure 5:
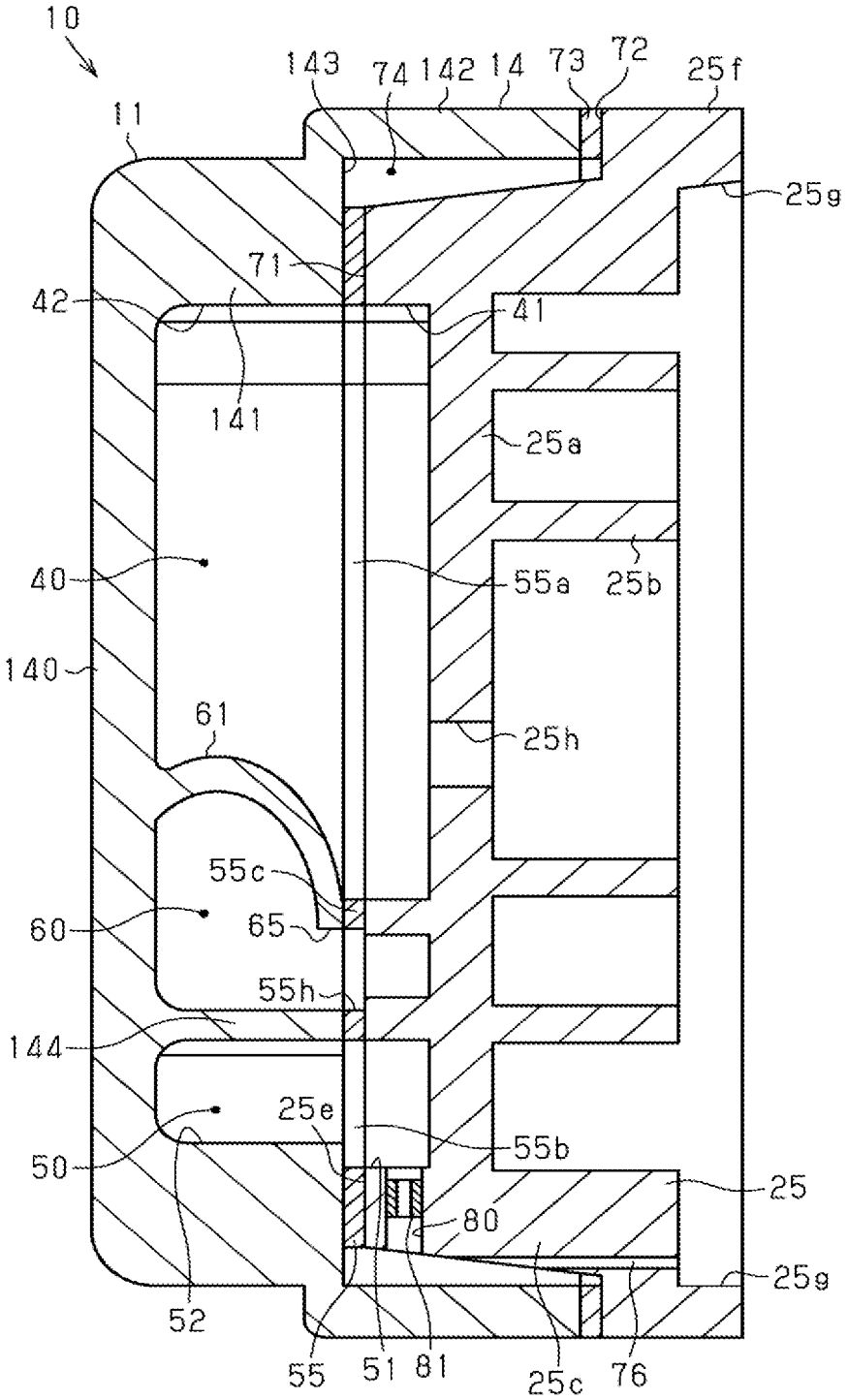
FIG. 5 is a cross-sectional view of a scroll electric compressor according to a modified embodiment in which a part of the scroll electric compressor is enlarged.

As illustrated in FIG. 5, a connection passage 80 that connects the annular space 74 with the oil storage chamber 50 may be formed in the fixed scroll 25. A throttle member 81 may be disposed in the connection passage 80. In this case, the throttle groove 75 is not formed in the gasket 55. The throttle member 81 is, for example, a tubular member and is fitted into the connection passage 80 to be fixed.

Thus, the annular space 74 serves as the oil storage chamber. The annular space 74 and the oil storage chamber 50 is connected through the connection passage 80, and the throttle member 81 is disposed in the connection passage 80. This allows oil separated from refrigerant in the oil separation chamber 60 to be easily stored in the oil storage chamber 50. For example, consider a driving condition in which oil stored in the oil storage chamber 50 easily flows to the annular space 74 through the connection passage 80. Even in this case, the oil flowing out to the annular space 74 is easily stored in the annular space 74, because the pressure of the annular space 74 is lower than the pressure in the oil storage chamber 50. Therefore, oil may be stably stored in one of the oil storage chamber 50 and the annular space 74 in any operational range of the scroll electric compressor 10. The connection passage 80 connecting the annular space 74 and the oil storage chamber 50 is a suitable site for forming the throttle member 81.

Figure 6:
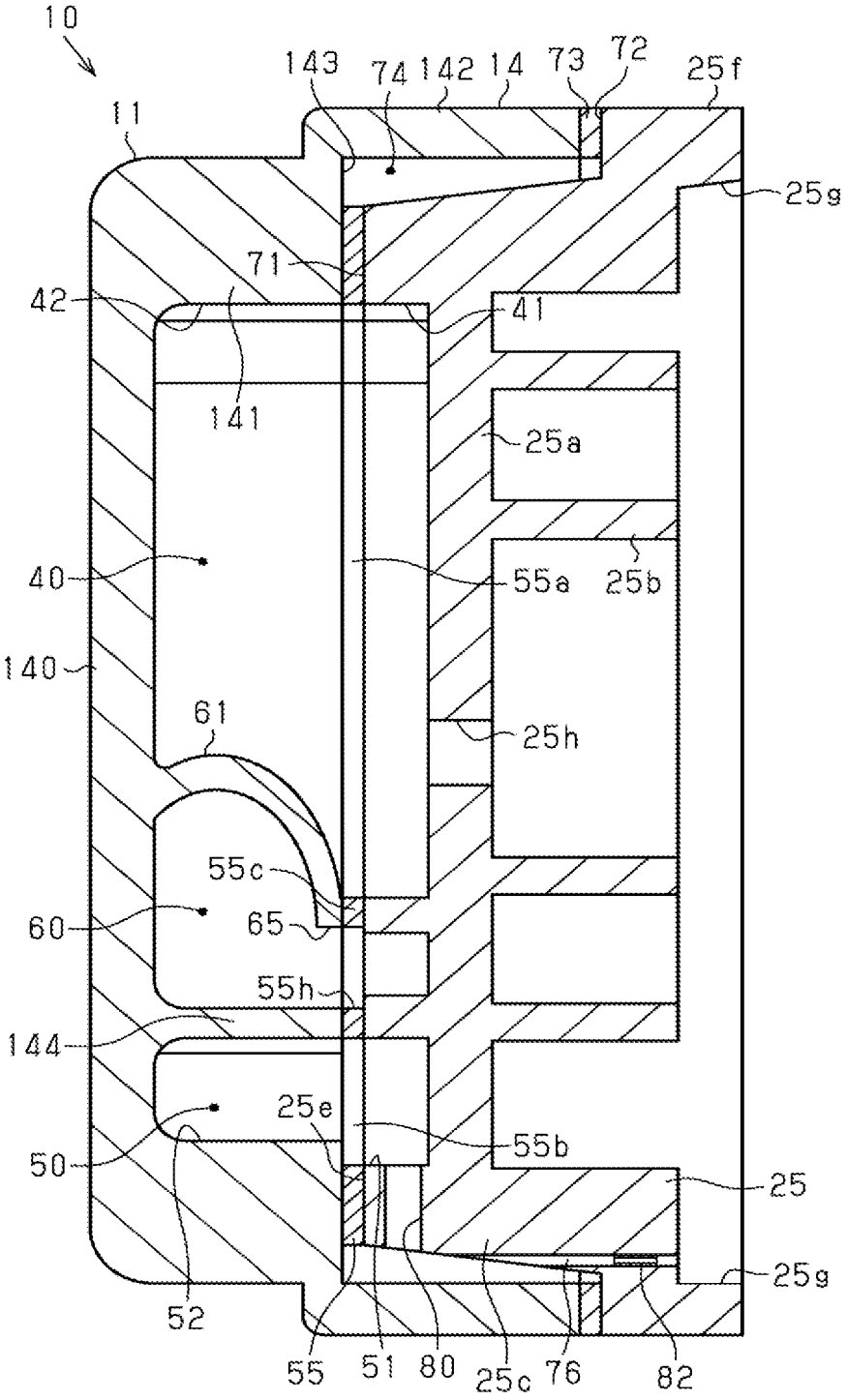
FIG. 6 is a cross-sectional view of a scroll electric compressor according to another modified embodiment in which a part of the scroll electric compressor is enlarged.

As illustrated in FIG. 6, a connection passage 80 that connects the annular space 74 with the oil storage chamber 50 may be formed in the fixed scroll 25. A throttle member 82 may be formed in the communication passage 76. That is, in the embodiment illustrated in FIG. 5, the throttle member 82 is provided in the communication passage 76, instead of providing the throttle member 81 in the connection passage 80. As a result, the annular space 74 is in the discharge pressure region. In this way, the annular space 74 may be in the discharge pressure region.

Thus, the annular space 74 serves as the oil storage chamber. Since the pressure of the annular space 74 is the same as that in the oil storage chamber 50, the oil stored in the oil storage chamber 50 flows to the annular space 74 smoothly through the connection passage 80. The throttle member 82 is provided in the communication passage 76, which allows the oil flowing to the annular space 74 to be stably stored in the annular space 74.

Figure 7:
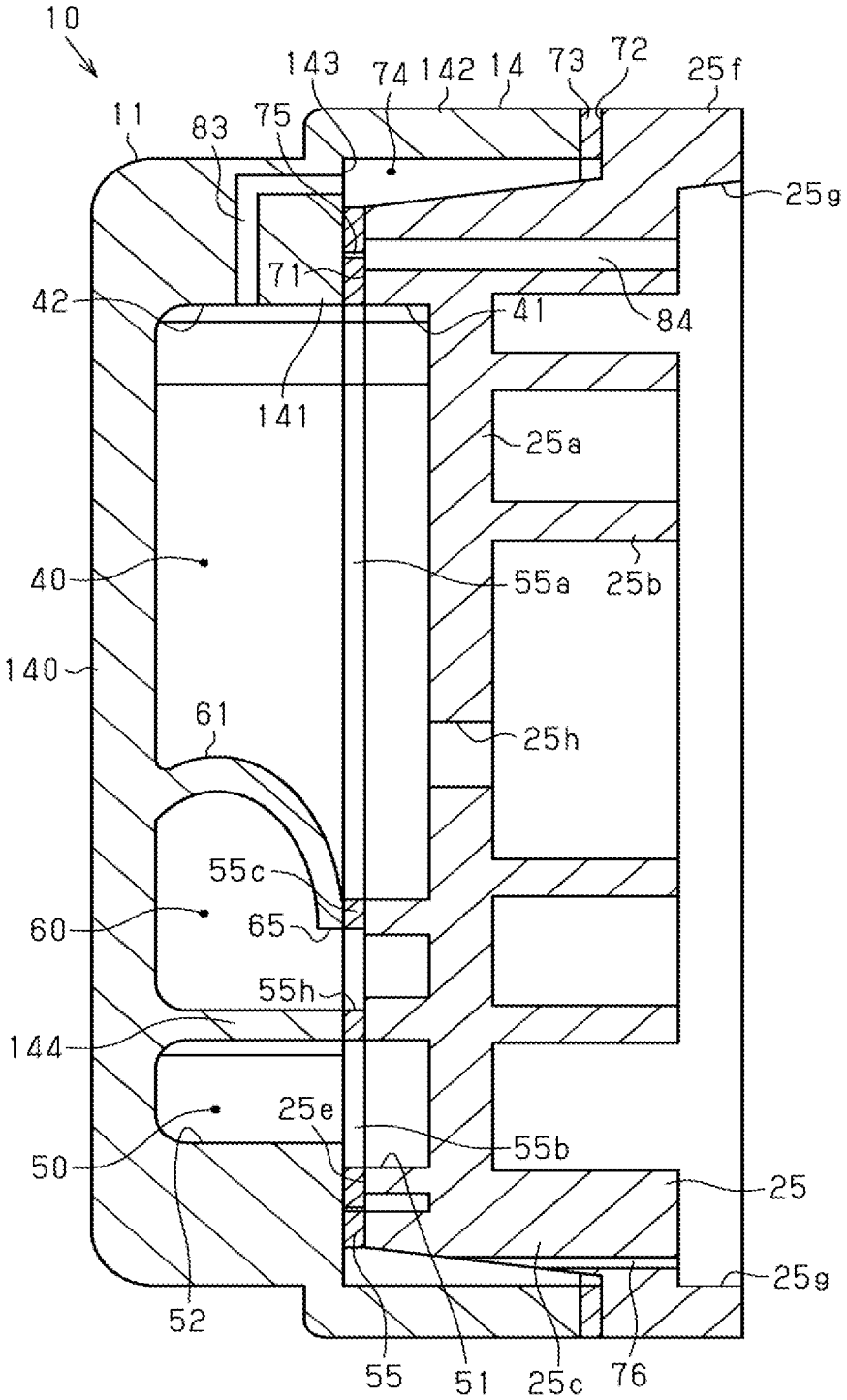
FIG. 7 is a cross-sectional view of a scroll electric compressor according to yet another modified embodiment in which a part of the scroll electric compressor is enlarged.

As illustrated in FIG. 7, the annular space 74 may be in communication with the discharge chamber 40. A passage 83 that makes the discharge chamber 40 and the annular space 74 in communication with each other is formed in the discharge housing 14. In this case, a through hole 84 that connects the throttle groove 75 with the passage recesses 25*g* is formed in the fixed scroll 25. Oil in the oil storage chamber 50 is to be recirculated into the passage recesses 25*g* through the throttle groove 75 and the through hole 84. Accordingly, the annular space 74 functions as the discharge chamber. As a result, a space used as the discharge chamber may be increased in the scroll electric compressor 10. This suppresses the pulsation of the refrigerant discharged to the discharge chamber, thereby reducing the noise and vibration of the scroll electric compressor 10.

In the embodiment, the outer peripheral surface of the outer peripheral wall 25*c* need not have a conical surface shape whose outer diameter increases as being away from the fixed scroll base plate 25*a*. For example, the outer peripheral surface of the outer peripheral wall 25*c* may extend in the axial direction of the rotary shaft 15. In other words, the shape of the outer peripheral surface of the outer peripheral wall 25*c* is not limited to any particular shape as long as the annular space 74 is defined between the second peripheral wall 142 and the outer peripheral wall 25*c* by the stepped portion 143, the second peripheral wall 142, and the outer peripheral wall 25*c*.

Although the scroll electric compressor 10 is used for the vehicle air-conditioning device in the embodiment, the use of the scroll electric compressor 10 is not limited to the vehicle air-conditioning device. The scroll electric compressor 10 may be used in any desirable manner as long as the scroll electric compressor 10 is used for compressing refrigerant.

What is claimed is:

1. A scroll electric compressor comprising:

a housing;

a rotary shaft rotatably supported by the housing;

an electric motor configured to rotate the rotary shaft;

a fixed scroll having a fixed scroll base plate, a fixed scroll spiral wall that extends from the fixed scroll base plate, and an outer peripheral wall that extends from the fixed scroll base plate and surrounds the fixed scroll spiral wall;

an orbiting scroll having an orbiting scroll spiral wall that meshes with the fixed scroll spiral wall and is configured to make orbital motion with a rotation of the rotary shaft;

a compression chamber that is defined between the fixed scroll spiral wall and the orbiting scroll spiral wall, into which refrigerant from an outside is drawn, and in which the refrigerant is compressed;

a discharge chamber to which the refrigerant compressed in the compression chamber is discharged; and an oil storage chamber in which oil separated from the refrigerant discharged to the discharge chamber is stored, wherein the housing has a discharge housing including an end wall, a first peripheral wall that extends from the end wall in a tubular shape and is in contact with the fixed scroll base plate, a stepped portion that has an annular shape and extends outwardly from the first peripheral wall in a radial direction of the rotary shaft, and a second peripheral wall that extends from the stepped portion in a second direction opposite to a first direction that the first peripheral wall extends from the stepped portion in a tubular shape, the discharge chamber and the oil storage chamber are formed in a space defined by the end wall, the first peripheral wall, and the fixed scroll base plate, the fixed scroll has a flange that has an annular shape, projects from the outer peripheral wall in the radial direction, and is in contact with the second peripheral wall, the stepped portion, the second peripheral wall, the flange, and the outer peripheral wall cooperate to define an annular space around the fixed scroll, the annular space is in communication with the discharge chamber or the oil storage chamber, the stepped portion is separated from the end wall in an axial direction of the rotary shaft, and the second direction extends away from the end wall.

2. The scroll electric compressor according to claim 1, wherein the annular space is in communication with the oil storage chamber, the scroll electric compressor includes a gasket providing sealing between the discharge housing and the fixed scroll base plate, and the gasket has a throttle groove through which the annular space and the oil storage chamber are in communication.

3. The scroll electric compressor according to claim 1, wherein the annular space is in communication with the oil storage chamber, the fixed scroll has a connection passage connecting the annular space with the oil storage chamber, and a throttle member is disposed in the connection passage.

4. The scroll electric compressor according to claim 1, wherein the annular space is, through a communication passage, in communication with a suction pressure region that is in communication with the oil storage chamber and through which the refrigerant to be drawn into the compression chamber flows, the fixed scroll has a connection passage connecting the annular space with the oil storage chamber, and a throttle member is disposed in the communication passage.

5. The scroll electric compressor according to claim 1, wherein the annular space is in communication with the discharge chamber.

6. A scroll electric compressor comprising:

a housing;

a rotary shaft rotatably supported by the housing;

an electric motor configured to rotate the rotary shaft;

a fixed scroll having a fixed scroll base plate, a fixed scroll spiral wall that extends f rom the fixed scroll base plate, and an outer peripheral wall that extends from the fixed scroll base plate and surrounds the fixed scroll spiral wall;

an orbiting scroll having an orbiting scroll spiral wall that meshes with the fixed scroll spiral wall and is configured to make orbital motion with a rotation of the rotary shaft;

a compression chamber that is defined between the fixed scroll spiral wall and the orbiting scroll spiral wall, into which refrigerant from an outside is drawn, and in which the refrigerant is compressed;

a discharge chamber to which the refrigerant compressed in the compression chamber is discharged; and an oil storage chamber in which oil separated from the refrigerant discharged to the discharge chamber is stored, wherein the housing has a discharge housing including an end wall, a first peripheral wall that extends from the end wall in a tubular shape and is in contact with the fixed scroll base plate, a stepped portion that has an annular shape and extends outwardly from the first peripheral wall in a radial direction of the rotary shaft, and a second peripheral wall that extends from the stepped portion in a second direction opposite to a first direction that the first peripheral wall extends from the stepped portion in a tubular shape, the discharge chamber and the oil storage chamber are formed in a space defined by the end wall, the first peripheral wall, and the fixed scroll base plate, the fixed scroll has a flange that has an annular shape, projects from the outer peripheral wall in the radial direction, and is in contact with the second peripheral wall, the stepped portion, the second peripheral wall, the flange, and the outer peripheral wall cooperate to define an annular space around the fixed scroll, the annular space is in communication with the discharge chamber or the oil storage chamber, and the flange projects from an end of an outer peripheral surface of the outer peripheral wall on a side of the outer peripheral wall opposite to the fixed scroll base plate in the radial direction.

7. A scroll electric compressor comprising:

a housing;

a rotary shaft rotatably supported by the housing;

an electric motor configured to rotate the rotary shaft;

a fixed scroll having a fixed scroll base plate, a fixed scroll spiral wall that extends f rom the fixed scroll base plate, and an outer peripheral wall that extends from the fixed scroll base plate and surrounds the fixed scroll spiral wall;

an orbiting scroll having an orbiting scroll spiral wall that meshes with the fixed scroll spiral wall and is configured to make orbital motion with a rotation of the rotary shaft;

a compression chamber that is defined between the fixed scroll spiral wall and the orbiting scroll spiral wall, into which refrigerant from an outside is drawn, and in which the refrigerant is compressed;

a discharge chamber to which the refrigerant compressed in the compression chamber is discharged; and an oil storage chamber in which oil separated from the refrigerant discharged to the discharge chamber is stored, wherein the housing has a discharge housing including an end wall, a first peripheral wall that extends from the end wall in a tubular shape and is in contact with the fixed scroll base plate, a stepped portion that has an annular shape and extends outwardly from the first peripheral wall in a radial direction of the rotary shaft, and a second peripheral wall that extends from the stepped portion in a second direction opposite to a first direction that the first peripheral wall extends from the stepped portion in a tubular shape, the discharge chamber and the oil storage chamber are formed in a space defined by the end wall, the first peripheral wall, and the fixed scroll base plate, the fixed scroll has a flange that has an annular shape, projects from the outer peripheral wall in the radial direction, and is in contact with the second peripheral wall, the stepped portion, the second peripheral wall, the flange, and the outer peripheral wall cooperate to define an annular space around the fixed scroll, the annular space is in communication with the discharge chamber or the oil storage chamber, the oil storage chamber is disposed at a position outward from the discharge chamber in the radial direction, and the scroll electric compressor is configured such that, when mounted on a vehicle, the oil storage chamber is positioned lower than the discharge chamber.

* * * * *